US009027519B2

(12) United States Patent
Tadokoro et al.

(10) Patent No.: US 9,027,519 B2
(45) Date of Patent: May 12, 2015

(54) VALVE TIMING CONTROL APPARATUS OF INTERNAL COMBUSTION ENGINE

(71) Applicant: Hitachi Automotive Systems, Ltd., Hitachinaka-shi, Ibaraki (JP)

(72) Inventors: Ryo Tadokoro, Atsugi (JP); Hiroyuki Nemoto, Hitachi (JP); Atsushi Yamanaka, Atsugi (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 281 days.

(21) Appl. No.: 14/080,077

(22) Filed: Nov. 14, 2013

(65) Prior Publication Data

US 2014/0137821 A1 May 22, 2014

(30) Foreign Application Priority Data

Nov. 16, 2012 (JP) ..... 2012-251790

(51) Int. Cl.
*F01L 1/34* (2006.01)
*F01L 1/344* (2006.01)

(52) U.S. Cl.
CPC ..... *F01L 1/344* (2013.01); *F01L 2820/032* (2013.01)

(58) Field of Classification Search
USPC ..... 123/90.15, 90.17; 464/160
See application file for complete search history.

(56) References Cited

U.S. PATENT DOCUMENTS 7,624,710 B2 * 12/2009 Uehama et al. ..... 123/90.17

FOREIGN PATENT DOCUMENTS

JP 2011-256798 A 12/2011

* cited by examiner

*Primary Examiner* — Ching Chang
(74) *Attorney, Agent, or Firm* — Foley & Lardner LLP

(57) ABSTRACT

In an electrically-driven valve timing control apparatus employing a housing and a cover member axially opposed to each other, a cylindrical-hollow motor output shaft is installed in the housing, and configured to rotate relative to the housing by electricity-feeding to the electric motor, and also configured such that lubricating oil is supplied into the motor output shaft. A plug is fitted to the inner periphery of an axial opening end of the motor output shaft for suppressing a leakage of lubricating oil from the motor output shaft to the outside. One of two opposing faces of the cover member and the plug is formed with a protruding portion configured to prevent the plug's slipping out of the axial opening end. A part of the inside face of the cover member, opposed to the plug, is formed integral with the protruding portion partially disposed within the axial opening end.

16 Claims, 8 Drawing Sheets

VALVE TIMING CONTROL APPARATUS OF INTERNAL COMBUSTION ENGINE

TECHNICAL FIELD

The present invention relates to a valve timing control apparatus of an internal combustion engine for variably controlling valve timing of an engine valve, such as an intake valve and/or an exhaust valve, depending on an engine operating condition.

BACKGROUND ART

In recent years, there have been proposed and developed various variable valve timing control apparatus in which an angular phase of a camshaft relative to a timing sprocket, configured to rotate in synchronism with rotation of an engine crankshaft, is changed by transmitting rotary motion (torque) of an electric motor, through a speed reducer (in other words, a torque multiplier) to the camshaft, so as to variably control engine valve characteristics, such as valve closure timing and valve open timing of an engine valve (intake and/or exhaust valves).

One such electric-motor-driven phase-converter equipped variable valve timing control (VTC) apparatus has been disclosed in Japanese Patent Provisional Publication No. 2011-256798 (hereinafter is referred to as "JP2011-256798"). In the VTC apparatus disclosed in JP2011-256798, the output shaft of the electric motor is formed into a cylindrical-hollow shape, and bearing parts, such as a ball bearing and a needle bearing, are placed in the cylindrical-hollow motor output shaft. This machine-bearings layout contributes to the reduced entire axial length of the VTC apparatus, that is, the small-size VTC apparatus. Furthermore, bearing lubrication is made by supplying lubricating oil to the internal space of the cylindrical-hollow motor output shaft.

Also, electricity-feeding to the electric motor is achieved by sliding-contact of brushes, installed in a cover member configured to cover the front end of the electric motor of the phase converter, with respective slip rings of the electric-motor side. Hence, a plug is press-fitted into the front opening end of the cylindrical-hollow motor output shaft for preventing lubricating oil in the cylindrical-hollow motor output shaft from flowing toward and adhering to the brushes and slip rings.

SUMMARY OF THE INVENTION

However, in the VTC apparatus disclosed in JP2011-256798, there is a possibility for the plug to slip out of the front opening end of the cylindrical-hollow motor output shaft by hydraulic pressure of lubricating oil supplied into the motor output shaft. For this reason, an axial clearance defined between the front end face of the cylindrical-hollow motor output shaft and the inner peripheral surface of the cover member, axially opposed to each other, is set or dimensioned to be smaller than the axial length of the plug.

In the case of such setting of the axial clearance to the prescribed small dimension, there is an increased tendency for the front end of the cylindrical-hollow motor output shaft to be brought into wall-contact with the inner peripheral surface of the cover member by a slight axial displacement of the cylindrical-hollow motor output shaft toward the cover member owing to vibrations, produced during rotary motion of the camshaft. To avoid this, suppose that the axial clearance is set to a larger dimension. In such a case, the axial length of the plug has to be set longer. This leads to the increased entire axial length of the VTC apparatus, that is, the large-size VTC apparatus.

Accordingly, it is an object of the invention to provide a valve timing control (VTC) apparatus of an internal combustion engine capable of avoiding a plug, press-fitted into a front opening end of a cylindrical-hollow output shaft of an electric motor of a phase converter, from slipping out of the cylindrical-hollow motor output shaft, while preventing a wall contact between the front end of the cylindrical-hollow motor output shaft and the inner peripheral surface of a cover member, axially opposed to each other, without increasing the size of the VTC apparatus.

In order to accomplish the aforementioned and other objects of the present invention, a valve timing control apparatus of an internal combustion engine, comprises a driving rotary member adapted to be driven by a crankshaft of the engine, a driven rotary member adapted to be fixedly connected to a camshaft and configured to rotate relative to the driving rotary member, an electric motor for rotating the driven rotary member relative to the driving rotary member by rotation of the electric motor, a housing integrally connected to the driving rotary member and configured to house therein component parts of the electric motor, a cover member adapted to be fixedly connected to an engine body and arranged to be opposed to a front end of the housing, a slip-ring feeder device provided for electricity-feeding to the electric motor and attached to one of the front end of the housing and an inside face of the cover member opposed to each other, a brush feeder device attached to the other of the housing and the cover member and configured to be kept in electric-contact with the slip-ring feeder device for electricity-feeding to the electric motor, a cylindrical-hollow motor output shaft installed in the housing, and configured to rotate relative to the housing by electricity-feeding to the electric motor, and also configured such that lubricating oil is supplied into the cylindrical-hollow motor output shaft, a bearing device disposed between an outer periphery of a cylindrical portion of the driven member and an inner periphery of the cylindrical-hollow motor output shaft, a plug fitted to an inner peripheral surface of an axial opening end of the cylindrical-hollow motor output shaft opposed to the cover member for suppressing a leakage of lubricating oil, supplied into the motor output shaft, to an outside, and a seal member interleaved between the cover member and the housing for suppressing lubricating oil from entering a surface of electric-contact between the slip-ring feeder device and the brush feeder device, wherein a part of the inside face of the cover member, opposed to a front end face of the plug, is formed integral with a protruding portion, and a top of the protruding portion is partially disposed within the axial opening end of the cylindrical-hollow motor output shaft.

According to another aspect of the invention, a valve timing control apparatus of an internal combustion engine, comprises a driving rotary member adapted to be driven by a crankshaft of the engine, a driven rotary member adapted to be fixedly connected to a camshaft and configured to rotate relative to the driving rotary member, an electric motor for rotating the driven rotary member relative to the driving rotary member by rotation of the electric motor, a housing integrally connected to the driving rotary member and configured to house therein component parts of the electric motor, a cover member adapted to be fixedly connected to an engine body and arranged to be opposed to a front end of the housing, a slip-ring feeder device provided for electricity-feeding to the electric motor and attached to one of the front end of the housing and an inside face of the cover member opposed to each other, a brush feeder device attached to the other of the housing and the cover member and configured to be kept in electric-contact with the slip-ring feeder device for electricity-feeding to the electric motor, a cylindrical-hollow motor output shaft installed in the housing, and configured to rotate relative to the housing by electricity-feeding to the electric motor, and also configured such that lubricating oil is supplied into the cylindrical-hollow motor output shaft, a bearing device disposed between an outer periphery of a cylindrical portion of the driven member and an inner periphery of the cylindrical-hollow motor output shaft, a plug fitted to an inner peripheral surface of an axial opening end of the cylindrical-hollow motor output shaft opposed to the cover member for suppressing a leakage of lubricating oil, supplied into the motor output shaft, to an outside, and a seal member interleaved between the cover member and the housing for suppressing lubricating oil from entering a surface of electric-contact between the slip-ring feeder device and the brush feeder device, wherein a part of the inside face of the cover member, opposed to a front end face of the plug, is formed integral with a protruding portion, and an axial clearance defined between a top face of the protruding portion and the axial opening end of the cylindrical-hollow motor output shaft, facing the top face of the protruding portion, is dimensioned to be less than an axial length of the plug.

According to a further aspect of the invention, a valve timing control apparatus of an internal combustion engine, comprises a driving rotary member adapted to be driven by a crankshaft of the engine, a driven rotary member adapted to be fixedly connected to a camshaft and configured to rotate relative to the driving rotary member, an electric motor for rotating the driven rotary member relative to the driving rotary member by rotation of the electric motor, a housing integrally connected to the driving rotary member and configured to house therein component parts of the electric motor, a cover member adapted to be fixedly connected to an engine body and arranged to be opposed to a front end of the housing, a slip-ring feeder device provided for electricity-feeding to the electric motor and attached to one of the front end of the housing and an inside face of the cover member opposed to each other, a brush feeder device attached to the other of the housing and the cover member and configured to be kept in electric-contact with the slip-ring feeder device for electricity-feeding to the electric motor, a cylindrical-hollow motor output shaft installed in the housing, and configured to rotate relative to the housing by electricity-feeding to the electric motor, and also configured such that lubricating oil is supplied into the cylindrical-hollow motor output shaft, a bearing device disposed between an outer periphery of a cylindrical portion of the driven member and an inner periphery of the cylindrical-hollow motor output shaft, a plug fitted to an inner peripheral surface of an axial opening end of the cylindrical-hollow motor output shaft opposed to the cover member for suppressing a leakage of lubricating oil, supplied into the motor output shaft, to an outside, and a seal member interleaved between the cover member and the housing for suppressing lubricating oil from entering a surface of electric-contact between the slip-ring feeder device (26*a*-26*b*) and the brush feeder device, wherein one of two opposing faces of the cover member and the plug is formed with a protruding portion having a function that prevents the plug's slipping out of the axial opening end of the cylindrical-hollow motor output shaft.

The other objects and features of this invention will become understood from the following description with reference to the accompanying drawings.

DESCRIPTION OF THE PREFERRED EMBODIMENTS

[First Embodiment]

Figure 1:
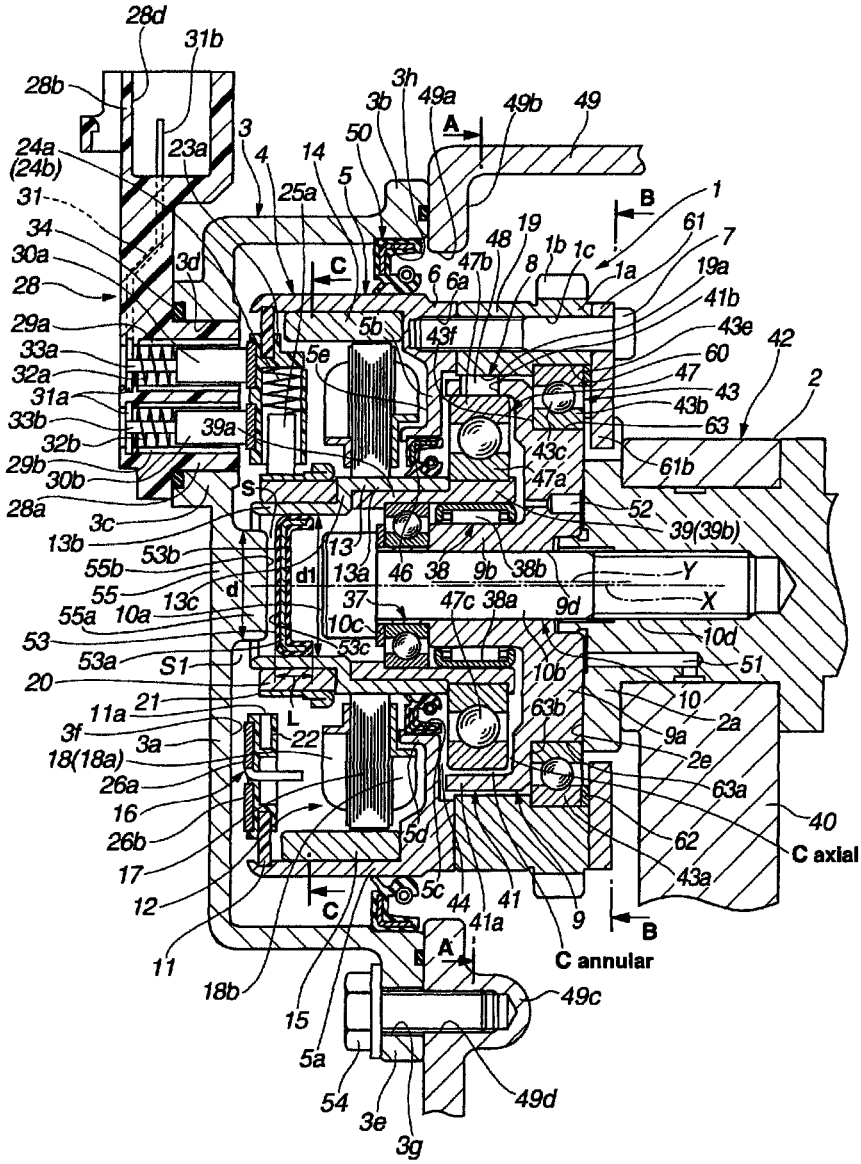
FIG. 1 is a longitudinal cross-sectional view illustrating a first embodiment of a valve timing control (VTC) apparatus.

Referring now to the drawings, particularly to FIGS. 1-5, the valve timing control apparatus of the embodiment is exemplified in a variable valve timing control (VTC) device of an internal combustion engine.

Figure 2:
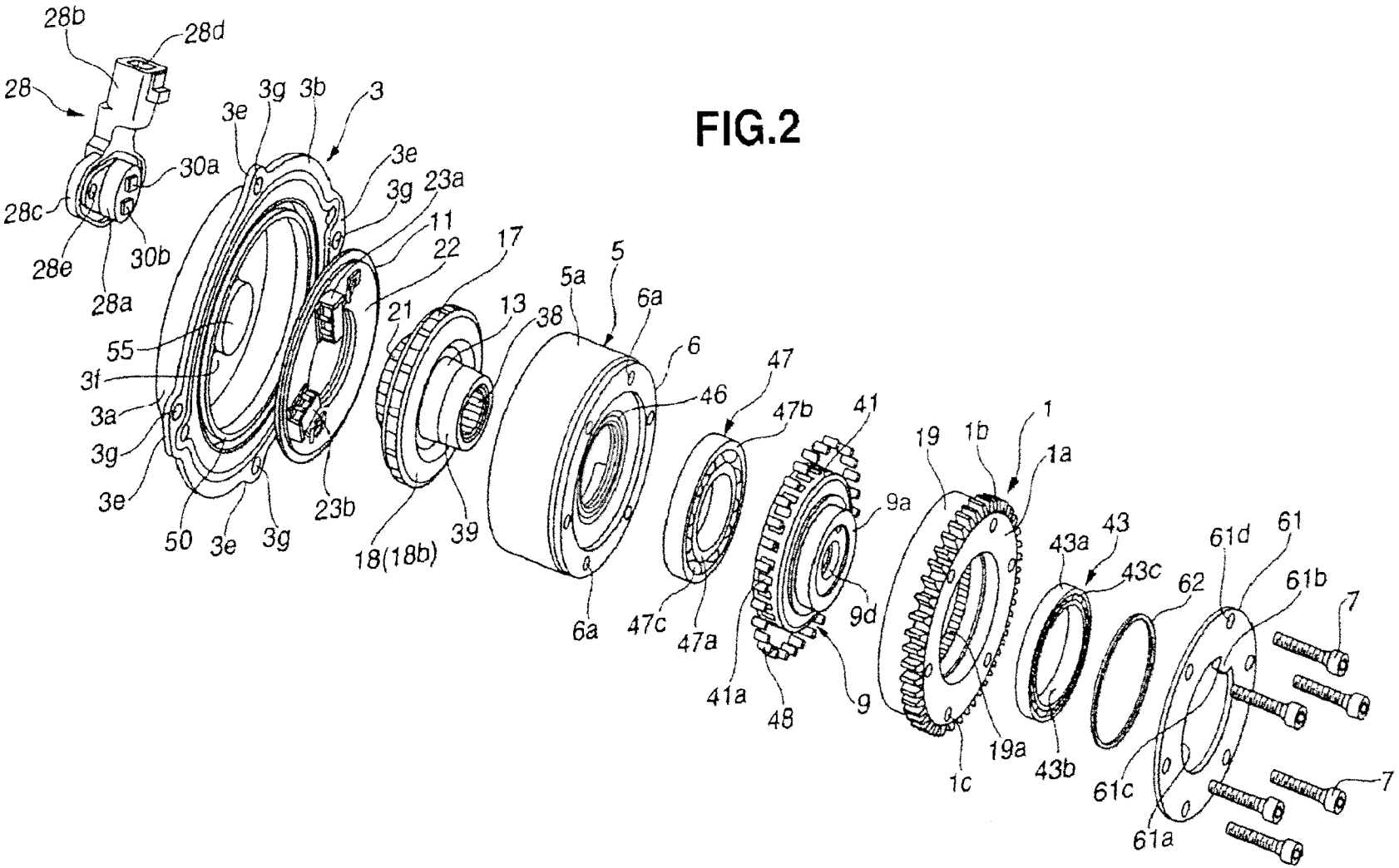
FIG. 2 is a perspective disassembled view illustrating major component parts constructing the VTC apparatus of the first embodiment.

As shown in FIGS. 1-2, the VTC apparatus of the embodiment is comprised of a timing sprocket 1 (serving as a driving rotary member) that rotates in synchronism with rotation of an engine crankshaft, a camshaft 2 rotatably supported on a cylinder head 40 through camshaft-journal bearings 42 and driven by torque transmitted from the timing sprocket 1, a cover member 3 laid out in front of the timing sprocket 1 and bolted to a chain cover 49, and a phase converter 4 installed between timing sprocket 1 and camshaft 2 for changing a relative angular phase between timing sprocket 1 and camshaft 2 depending on an engine operating condition.

Timing sprocket 1 is comprised of an annular sprocket body 1*a*, a timing gear 1*b* formed integral with the outer periphery of sprocket body 1*a*, and an internal-tooth structural member 19. Sprocket body 1*a* is made from iron-based metal material, and formed with a stepped inner peripheral portion and formed integral with the timing gear 1*b*. Timing gear 1*b* receives torque from the crankshaft through a timing chain (not shown) wound on both a sprocket on the crankshaft and the timing sprocket 1 on the camshaft. Internal-tooth structural member 19 is formed integral with the front end of sprocket body 1*a*.

Also, timing sprocket 1 is rotatably supported by a large-diameter ball bearing 43 interleaved between the sprocket body 1*a* and a driven rotary member, simply, a driven member 9 (described later) fixedly connected to the front end of camshaft 2, so as to permit rotary motion of camshaft 2 relative to timing sprocket 1.

Large-diameter ball bearing 43 is comprised of an outer ring 43*a*, an inner ring 43*b*, and balls 43*c* confined between outer and inner rings 43*a*-43*b*. The outer ring 43*a* of ball bearing 43 is fixed to the inner periphery of sprocket body 1*a*, whereas the inner ring 43*b* of ball bearing 43 is fixed to the outer periphery of driven member 9 (described later).

Sprocket body 1*a* has an outer-ring retaining annular groove 60 formed and cut in its inner peripheral surface and facing the camshaft side.

Outer-ring retaining annular groove 60 is formed as a shouldered annular groove into which the outer ring 43*a* of large-diameter ball bearing 43 is axially press-fitted. The shouldered portion of outer-ring retaining annular groove 60 serves to position one axial end face (i.e., a forward end face, viewing FIG. 1) of the outer ring 43*a* in place.

Internal-tooth structural member 19 is formed integral with the circumference of the front end of sprocket body 1*a*, and formed into a cylindrical shape extended toward an electric motor 12 of phase converter 4. Internal-tooth structural member 19 is formed on its inner periphery with a plurality of waveform internal teeth 19*a*.

The annular rear end face of an annular female screw-threaded member 6, formed integral with a housing 5 (described later), and the annular front end face of internal-tooth structural member 19 are arranged to be axially opposed to each other.

An annular retainer plate 61 is located at the rear end of sprocket body 1*a*, facing apart from the internal-tooth structural member 19. Retainer plate 61 is made from a metal plate. As shown in FIG. 1, the outside diameter of retainer plate 61 is dimensioned to be approximately equal to that of the sprocket body 1*a*. The inside diameter of retainer plate 61 is set or dimensioned to be less than the inside diameter of the outer ring 43*a* of ball bearing 43 and also dimensioned to be approximately equal to the outside diameter of the inner ring 43*b* of ball bearing 43.

Hence, the inner peripheral portion 61*a* (see FIG. 2) of retainer plate 61 is arranged to be axially opposed to the rearward end face 43*e* of the outer ring 43*a* of ball bearing 43 with a given clearance space in such a manner as to cover the rearward end face 43*e* of the outer ring 43*a*. Also, the inner peripheral portion 61*a* of annular retainer plate 61 has a radially-inward protruding stopper 61*b* integrally formed at a given circumferential angular position of the inner peripheral portion 61*a*.

Figure 4:
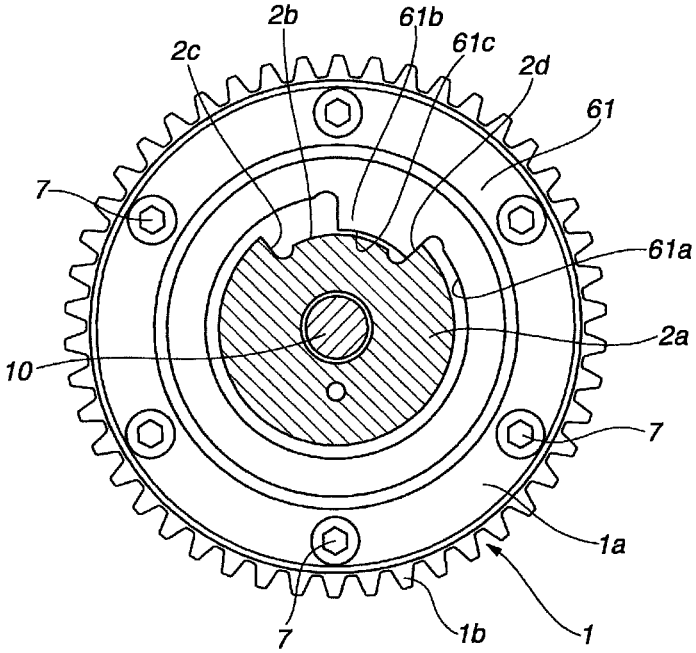
FIG. 4 is a lateral cross section taken along the line B-B of FIG. 1.

As seen in FIGS. 1 and 4, the radially-inward protruding stopper 61*b* is formed into a substantially sector. The innermost edge 61*c* of stopper 61*b* is configured to be substantially conformable to a shape of the circular-arc peripheral surface of a stopper groove 2*b* (described later) of the front end of camshaft 2. The outer peripheral portion of retainer plate 61 is formed with circumferentially equidistant-spaced, six bolt insertion holes 61*d* (through holes) through which bolts 7 are inserted.

Furthermore, an annular spacer 62 is interleaved between the inside face (the left-hand side face) of retainer plate 61 and the rearward end face 43*e* of the outer ring 43*a* of ball bearing 43. Spacer 62 is provided for applying a slight push from the inside face of retainer plate 61 to the rearward end face 43*e* of the outer ring 43*a*, when the annular female screw-threaded member 6 (housing 5), the timing sprocket 1, and the retainer plate 61 are integrally connected to each other by fastening them together with bolts 7. The thickness of spacer 62 is set to such a thickness that a very small clearance defined between the rearward end face 43*e* of the outer ring 43*a* and the inside face of retainer plate 61 is within a permissible axial-movement range of the outer ring 43*a*.

In a similar manner to the six bolt insertion holes 61*d* (through holes) formed in the retainer plate 61, the outer peripheral portion of sprocket body 1*a* (internal-tooth structural member 19) is formed with circumferentially equidistant-spaced, six bolt insertion holes 1*c* (through holes). On the other hand, the annular female screw-threaded member 6 is formed with six female screw threads 6*a* configured to be conformable to respective circumferential positions of bolt insertion holes 1*c* (bolt insertion holes 61*d*). Hence, the annular female screw-threaded member 6 (the housing 5), the timing sprocket 1, and the retainer plate 61 are integrally connected to each other by axially fastening them together with bolts 7.

By the way, in the shown embodiment, the sprocket body 1*a* and the internal-tooth structural member 19 are configured as a casing of a speed reducer 8 (described later).

Outside diameters of the sprocket body 1*a*, the internal-tooth structural member 19, the retainer plate 61, and the female screw-threaded member 6 are dimensioned to be almost the same.

As shown in FIG. 1, chain cover 49 is laid out and bolted to the front end of an engine body (i.e., a cylinder block and cylinder head 40) in a manner so as to vertically extend for covering the timing chain (not shown) wound on the timing sprocket 1. Chain cover 49 has a substantially circular opening 49*a* configured to be conformable to the contour of the phase converter 4. The opening 49*a* is formed in an annular wall 49*b* of the front end of chain cover 49. Annular wall 49*b* has four boss sections 49*c* integrally formed on the inner periphery of annular wall 49*b* and circumferentially spaced from each other. Four female screw-threads 49*d* are machined in respective boss sections 49*c* such that female screw-threads 49*d* extend from the front end face of annular wall 49*b* into the respective boss sections.

As shown in FIGS. 1-2, cover member 3 is made from aluminum alloy and formed into a substantially cup shape. Cover member 3 is comprised of a cup-shaped cover main body 3*a* and an annular flange 3*b* formed integral with the circumference of the right-hand side opening end (viewing FIG. 1) of cover main body 3*a*. Cover main body 3*a* is configured to cover the front end of housing 5. Cover main body 3*a* has a slightly axially-extending cylindrical wall portion 3*c* integrally formed at a given position deviated upward from the center of the frontal flat wall portion of cover main body 3*a*. The cylindrical wall portion 3*c* has a retaining through-hole 3*d* formed therein. The inner peripheral surface of retaining through-hole 3*d* is configured as a guide face for a brush retainer 28 (described later).

Annular flange 3*b* is integrally formed with four tab-like portions 3*e*, circumferentially spaced apart from each other at intervals of approximately 90 degrees. Four bolt insertion holes 3*g* (through holes) are bored in respective tab-like portions 3*e* of the annular flange 3*b*. Cover member 3 is fixedly connected to the chain cover 49 by means of bolts 54, which are inserted through the respective bolt insertion holes 3*g* and screwed into the female screw-threads 49*d* formed in the respective boss sections 49*c* of chain cover 49.

Furthermore, cover main body 3*a* is integrally formed at a substantially center of the inside face of the frontal flat wall portion with an axially rearward protruding portion (simply, a protruding portion) 55. As clearly shown in FIGS. 1-2, protruding portion 55 is formed into a columnar shape (or a disk shape). The position (the central axis) of protruding portion 55, formed integral with the inner peripheral surface of the frontal flat wall portion of cover main body 3*a*, is arranged to be substantially concentric to the axis of a motor output shaft 13 (described later). Also, the outside diameter "d" (the contour) of protruding portion 55 is configured or formed approximately uniformly, and dimensioned to be somewhat less than the inside diameter "d1" of motor output shaft 13. The top 55*a* of protruding portion 55, whose top face is formed as a flat end face 55*b*, is partially disposed within the internal space of the front end of motor output shaft 13.

As shown in FIG. 2, the inner periphery of the right-hand side opening end (viewing FIG. 1) of cover main body 3*a* is formed as a shouldered oil-seal retaining annular groove 3*h*.

A large-diameter oil seal (a seal member) 50 is interleaved between the shouldered oil-seal retaining annular groove 3*h* of cover main body 3*a* and the outer peripheral surface of housing 5. Large-diameter oil seal 50 is formed into a substantially C-shape in lateral cross section. Oil seal 50 is made from synthetic rubber (a base material), and also a core metal is buried in the base material. The cylindrical outer peripheral surface of oil seal 50 is fitted to the shouldered oil-seal retaining annular groove 3*h* of cover main body 3*a* in a fluid-tight fashion, whereas the inner periphery of oil seal 50 (that is, a spring-loaded single lip and a non-spring-loaded dust lip) is fitted onto the outer periphery of housing 5 in a fluid-tight fashion.

Housing 5 is comprised of a housing main body 5*a* made from iron-based metal material and formed into a substantially cylindrical shape with a rear end face (a bottom face) by pressing, and a seal plate 11 made from synthetic resin (non-magnetic material) and provided for sealing the axially forward opening (the left-hand side opening end, viewing FIG. 1) of housing main body 5*a*.

Housing main body 5*a* has a bottom 5*b* formed at its rear end. Housing main body 5*a* is formed in a substantially center of the bottom 5*b* with a large-diameter eccentric-shaft insertion hole 5*c* into which an eccentric shaft 39 (described later) is inserted. An axially-leftward extending cylindrical portion 5*d* is formed integral with the annular edge of eccentric-shaft insertion hole 5*c* in a manner so as to somewhat extend in the axial direction of camshaft 2. The previously-discussed annular female screw-threaded member 6 is formed integral with the outer periphery of the bottom 5*b* of housing 5.

Camshaft 2 has two drive cams (per cylinder) integrally formed on its outer periphery for operating the associated two intake valves (not shown) per one engine cylinder. Also, camshaft 2 has a flanged portion 2*a* integrally formed at its front end.

The outside diameter of flanged portion 2*a* is dimensioned to be slightly greater than that of a fixed-end portion 9*a* (see FIG. 1) of driven member 9 (described later). Hence, after installation of all component parts, the circumference of the front end face 2*e* of the flanged portion 2*a* of camshaft 2 is brought into abutted-engagement with the rearward end face of the inner ring 43*b* of large-diameter ball bearing 43. Driven member 9 is fixedly connected to the front end of camshaft 2 by means of a cam bolt 10 under a condition where the front end face 2*e* of the flanged portion 2*a* of camshaft 2 has been kept in abutted-engagement with the rear end face of the fixed-end portion 9*a* of driven member 9.

As shown in FIG. 4, the outer periphery of the flanged portion 2*a* of camshaft 2 is partially machined or cut as the stopper groove 2*b* recessed along the circumferential direction. The radially-inward protruding stopper 61*b* of retainer plate 61 is circumferentially moveably installed in the stopper groove 2*b*. Stopper groove 2*b* is formed into a circular-arc shape having a specified circumferential length to permit a circumferential movement of stopper 61*b* within a limited motion range determined based on the specified circumferential length. Hence, a maximum phase-advance position of camshaft 2 relative to timing sprocket 1 is restricted by abutment between the counterclockwise edge of stopper 61*b* and the clockwise edge 2*c* of stopper groove 2*b*. On the other hand, a maximum phase-retard position of camshaft 2 relative to timing sprocket 1 is restricted by abutment between the clockwise edge of stopper 61*b* and the counterclockwise edge 2*d* of stopper groove 2*b*.

As appreciated from the longitudinal cross section of FIG. 1, stopper 61*b* is kept in a spaced, contact-free relationship with the fixed-end portion 9*a* of driven member 9, thus adequately suppressing undesirable interference between the stopper 61*b* and the fixed-end portion 9*a*.

As discussed above, the radially-inward protruding stopper 61*b* of retainer plate 61 and the stopper groove 2*b* of the flanged portion 2*a* of camshaft 2 construct a stopper mechanism.

As appreciated from the longitudinal cross section of FIG. 1, cam bolt 10 is comprised of a head 10*a* and a shank 10*b* formed integral with each other, and an annular washer 10*c* provided at the boundary of head 10*a* and shank 10*b*. Shank 10*b* is formed on its outer periphery with a male-screw-threaded portion 10*d*, which is screwed into a female-screw-threaded portion machined into the front end of camshaft 2 along the axis of camshaft 2.

Driven member 9 is made from iron-based metal material. As seen from the longitudinal cross section of FIG. 1, the driven member 9 is comprised of the disk-shaped fixed-end portion 9*a*, an axially-forward-extending cylindrical portion 9*b* formed integral with the front end face of disk-shaped fixed-end portion 9*a*, and a substantially cylindrical cage 41, which cage is formed integral with the outer periphery of disk-shaped fixed-end portion 9*a* and configured to serve as a roller holder for holding a plurality of rollers 48 (rolling elements).

The rear end face of disk-shaped fixed-end portion 9*a* is arranged to abut with the front end face of the flanged portion 2*a* of camshaft 2, and fixedly connected to the flanged portion 2*a* by an axial force of cam bolt 10.

As shown in FIG. 1, cylindrical portion 9*b* is formed with a central bore 9*d* into which the shank 10*b* of cam bolt 10 is inserted. A needle bearing 38 is mounted on the outer periphery of cylindrical portion 9*b*.

Figure 3:
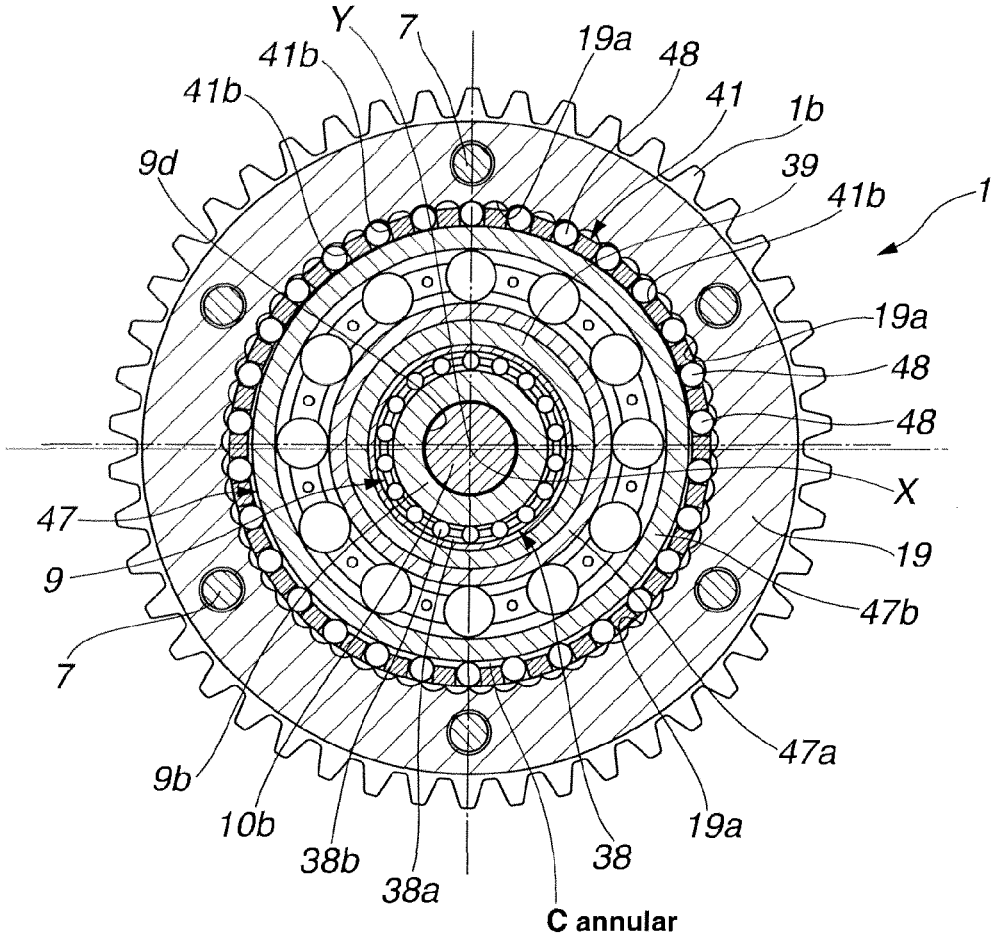
FIG. 3 is a lateral cross section taken along the line A-A of FIG. 1.

As shown in FIGS. 1-3, cage 41 (the roller holder) is configured to further extend from the outer periphery of disk-shaped fixed-end portion 9*a*, and bent into a substantially L shape in longitudinal cross section and formed into a substantially cylindrical shape extending in the same axial direction as the cylindrical portion 9*b* and having an annular bottom axially opposed to one sidewall of a ball-bearing outer ring 47*b* (described later). More concretely, the substantially cylindrical portion 41*a* of cage 41 is configured to extend toward the bottom 5*b* of housing 5 through an annular internal space 44 defined between the annular female screw-threaded member 6 and the axially-leftward extending cylindrical portion 5*d*. Also, the substantially cylindrical portion 41*a* of cage 41 has a plurality of axially-protruding lugs. As a whole, the axially-protruding lugs are shaped into a substantially comb-tooth shape. That is, by virtue of the axially-protruding lugs, each having a substantially rectangular cross-section, a plurality of roller-holding holes 41*b* are configured to be equidistant-spaced from each other with a given circumferential interval in the circumferential direction of the outer periphery of disk-shaped fixed-end portion 9*a*. Rollers 48 are rotatably held or installed in respective roller-holding holes 41*b*. The substantially cylindrical portion 41*a* of cage 41 has one fewer of the roller-holding holes (in other words, one fewer of the rollers or one fewer of the axially-protruding lugs) than the number of internal teeth 19*a* of internal-tooth structural member 19.

An inner-ring retaining annular groove 63 is machined and defined between the outer periphery of disk-shaped fixed-end portion 9*a* and the annular bottom of cage 41 formed integral with each other, for retaining the inner ring 43*b* of large-diameter ball bearing 43.

Inner-ring retaining annular groove 63 is formed as a shouldered annular groove configured to be radially opposed to the outer-ring retaining annular groove 60 of sprocket body 1*a*. Inner-ring retaining annular groove 63 is comprised of a cylindrical outer peripheral surface 63*a* extending in the axial direction of camshaft 2 and a radially-extending shouldered annular surface 63*b* configured to extend radially outward from the innermost end of the annular outer peripheral surface 63*a*. When assembling, the inner ring 43*b* of ball bearing 43 is axially press-fitted onto the cylindrical outer peripheral surface 63*a*. At the same time, the forward end face 43*f* of the press-fitted inner ring 43*b* is brought into abutted-engagement with the shouldered annular surface 63*b*, to position one axial end face (the forward end face 43*f*) of the inner ring 43*b* in place.

Phase converter 4 is constructed by the electric motor 12 coaxially located at the front end of camshaft 2, and the speed reducer 8 provided for reducing the rotational speed of the motor output shaft 13 of electric motor 12 and for transmitting the reduced motor speed (in other words, the increased motor torque) to the camshaft 2.

As seen in FIGS. 1-2, electric motor 12 is a brush-equipped direct-current (DC) motor. Electric motor 12 is comprised of the housing 5 serving as a yoke and rotating together with the timing sprocket 1, the motor output shaft 13 rotatably installed in the housing 5, a pair of substantially semi-circular permanent magnets 14-15 fixedly connected onto the inner peripheral surface of housing 5, and a stator 16 fixed to the seal plate 11.

Motor output shaft 13 is formed into a shouldered cylindrical-hollow shape, and serves as an armature. Motor output shaft 13 is constructed by a large-diameter portion 13*a* of the cam-shaft side and a small-diameter portion 13*b* of the brush-holder side through a shouldered portion 13*c* formed substantially at a midpoint of the axially-extending cylindrical-hollow motor output shaft. An iron-core rotor 17, having a plurality of magnetic poles, is fixedly connected onto the outer periphery of large-diameter portion 13*a*. Eccentric shaft 39 is axially press-fitted into the large-diameter portion 13*a*, in a manner so as to be axially positioned in place by the inside annular face of shouldered portion 13*c*.

An annular member 20 is press-fitted onto the outer periphery of small-diameter portion 13*b*. A commutator 21 is axially press-fitted onto the outer peripheral surface of annular member 20, in a manner so as to be axially positioned in place by the outside annular face of shouldered portion 13*c*. The outside diameter of annular member 20 is set or dimensioned to be approximately equal to that of large-diameter portion 13*a*. The axial length of annular member 20 is set or dimensioned to be slightly shorter than that of small-diameter portion 13*b*.

By virtue of the inside and outside annular faces of shouldered portion 13*c* of the axially-extending cylindrical-hollow motor output shaft 13, both the eccentric shaft 39 and the commutator 21 can be axially positioned. This ensures easy assembling work and improved positioning accuracy.

Also, an axial clearance "S1", having a prescribed dimension, is defined between the axially-protruding annular edged portion of small-diameter portion 13*b* and the inside face 3*f* of cover main body 3*a* of cover member 3, axially opposed to each other.

Furthermore, a plug 53 is fixed or press-fitted to the inner peripheral surface of small-diameter portion 13*b*, for preventing or adequately suppressing undesirable leakage of lubricating oil, which oil is supplied into the cylindrical-hollow motor output shaft 13 and eccentric shaft 39 for lubrication of a ball bearing 37 (described later) as well as the previously-discussed needle bearing 38, to the outside.

As best seen from the longitudinal cross section of FIG. 1, plug 53 is formed into a substantially C-shape in longitudinal cross section. Plug 53 is comprised of a core metal 53*a* and an elastic material (an elastic rubber material) 53*b* fully covering or fully coating around the entire surface of core metal 53*a*. To ensure a press-fitting margin, the outside diameter of plug 53 is dimensioned to be slightly greater than the inside diameter "d1" of small-diameter portion 13*b*. Additionally, a slight axial clearance "S" is defined between the front end face 53*c* of plug 53 and the flat end face 55*b* (the top face) of the top 55*a* of protruding portion 55, axially opposed to each other.

Iron-core rotor 17 is formed by a magnetic material having a plurality of magnetic poles. The outer periphery of iron-core rotor 17 is constructed as a bobbin having slots on which coil windings of an electromagnetic coil 18 is wound.

On the other hand, commutator 21 is formed as a substantially annular shape and made from a conductive material. Commutator 21 is divided into a plurality of segments whose number is equal to the number of magnetic poles of iron-core rotor 17. Terminals of the coil winding (not shown) drawn out from electromagnetic coil 18 are electrically connected to each of segments of commutator 21. That is, the terminals of the coil winding are sandwiched and electrically connected to the hemmed section formed on the periphery of commutator 21.

As a whole, the substantially semi-circular permanent magnets 14-15 are formed into a cylindrical shape, and have a plurality of magnetic poles in the circumferential direction. The axial position of each of permanent magnets 14-15 is offset forward from the fixed position of iron-core rotor 17. That is, as appreciated from the longitudinal cross section of FIG. 1, the axial center position of each of permanent magnets 14-15 is laid out to be offset forward from the axial center position of iron-core rotor 17 by a given axial distance, in other words, laid out to be offset toward the stator 16.

As appreciated from the longitudinal cross section of FIG. 1, by virtue of the offset layout of each of permanent magnets 14-15, the front end of each of permanent magnets 14-15 overlaps with the commutator 21 and also overlaps with a pair of first brushes 25*a*-25*b* (described later) of stator 16 in the axial direction.

Figure 5:
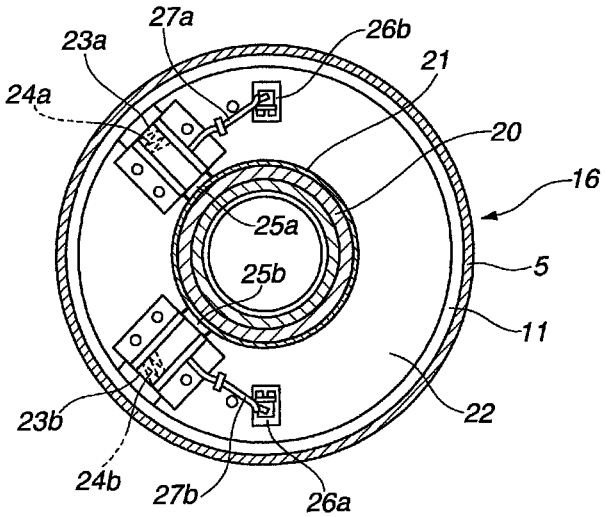
FIG. 5 is a lateral cross section taken along the line C-C of FIG. 1.

As shown in FIG. 5, stator 16 is mainly comprised of a disk-shaped synthetic-resin plate 22, a pair of synthetic-resin brush holders 23*a*-23*b*, a pair of first brushes 25*a*-25*b*, a radially-inside slip ring 26*a*, a radially-outside slip ring 26*b*, and pig-tale harnesses 27*a*-27*b*. Disk-shaped synthetic-resin plate 22 is integrally connected to the inner periphery of seal plate 11. Brush holders 23*a*-23*b* are attached onto the inside face of synthetic-resin plate 22. The first brushes 25*a*-25*b* serve as current-supply switching brushes and supported by respective holders 23*a*-23*b* so as to be radially slidable. The radially-inward ends of first brushes 25*a*-25*b* are kept in sliding-contact (elastic-contact or electric-contact) with the outer peripheral surface of commutator 21 by respective spring forces of coil springs 24*a*-24*b*. The radially-inside slip ring 26*a* and the radially-outside slip ring 26*b* are attached to the synthetic-resin plate 22, such that the outside face (the left-hand side face, viewing FIG. 1) of each of slip rings 26*a*-26*b* is partially exposed and that the inside face (the right-hand side face, viewing FIG. 1) of each of slip rings 26*a*-26*b* is buried in the front end face of synthetic-resin plate 22. The first brush 25*a* and the slip ring 26*b* are electrically connected to each other via the pig-tale harness 27*a*, whereas the first brush 25*b* and the slip ring 26*a* are electrically connected to each other via the pig-tale harness 27*b*. The radially-inside annular slip ring 26*a* and the radially-outside annular slip ring 26*b* are laid out to be coaxial with each other with a given aperture. By the way, slip rings 26*a*-26*b* construct part of a feeder circuit (a feeder device). First brushes 25*a*-25*b*, commutator 21, and pig-tale harnesses 27*a*-27*b* are constructed as a current-supply switching means.

The previously-discussed seal plate 11 is fitted into an annular groove cut in the inner periphery of the front end of the cylindrical housing main body 5*a* of housing 5, and fixedly connected to the front end of housing main body 5*a* in place by caulking. Also, the subassembly (11, 22) of seal plate 11 and disk-shaped synthetic-resin plate 22 is formed in its center with a shaft insertion hole 11*a* into which one axial end (the left-hand axial end, viewing FIG. 1) of motor output shaft 13 is partially inserted.

An integrally-molded synthetic-resin brush retainer 28, serving as part of the feeder device, is fixedly connected to the cover main body 3*a*. As shown in FIG. 1, brush retainer 28 is formed into a substantially L shape in side view. Brush retainer 28 is comprised of a substantially cylindrical brush-retaining portion 28*a*, a connector portion 28*b*, a pair of laterally-extending tab-like brackets 28*c*, 28*c* (see FIG. 2), and a pair of terminal strips 31, 31. Brush-retaining portion 28*a* is inserted into the retaining through-hole 3*d*. Connector portion 28*b* is formed integral with the upper end of brush-retaining portion 28*a*. Tab-like brackets 28*c*, 28*c* are formed integral with both sides of brush-retaining portion 28*a*. Most of terminal strips 31, 31 are buried in the synthetic-resin brush retainer 28.

Terminal strips 31, 31 are arranged parallel with each other in the vertical direction and partly cranked. One end (the downward terminal 31*a*) of each of the crank-shaped terminal strips 31 is exposed to the bottom of brush-retaining portion 28*a*. The other end (the upward terminal 31*b*) of each of terminal strips 31 is configured to protrude into a female fitting groove 28*d* of connector portion 28*b*. The upward terminals 31*b*, 31*b* of the two parallel terminal strips 31, 31 are electrically connected to a car battery (not shown) via a male socket (not shown) fitted to the female fitting groove 28*d*.

Brush-retaining portion 28*a* is configured to extend horizontally (axially). An upper hollow sleeve 29*a* is press-fitted into an upper cylindrical-hollow through hole bored in the brush-retaining portion 28*a*. In a similar manner, a lower hollow sleeve 29*b* is press-fitted into a lower cylindrical-hollow through hole bored in the brush-retaining portion 28*a*. A pair of second brushes 30*a*-30*b* are supported by respective hollow sleeves 29*a*-29*b* so as to be axially slidable. The tips of second brushes 30*a* and 30*b* are kept in sliding-contact (abutted-engagement or electric-contact) with respective slip rings 26*b* and 26*a*.

Each of second brushes 30*a*-30*b* is formed into a substantially rectangular parallelopiped shape. A second coil spring 32*a* is disposed between the downward terminal 31*a* exposed to the bottom of the upper cylindrical-hollow through hole of brush-retaining portion 28*a* and the second brush 30*a* under preload. In a similar manner, a second coil spring 32*b* is disposed between the downward terminal 31*a* exposed to the bottom of the lower cylindrical-hollow through hole of brush-retaining portion 28*a* and the second brush 30*b* under preload. Thus, the tips of second brushes 30*a* and 30*b* are permanently forced or biased toward respective slip rings 26*b* and 26*a* by the spring forces of second coil springs 32*a* and 32*b*.

Additionally, a flexible pig-tale harness 33*a* is connected between the square base of second brush 30*a* and the downward terminal 31*a* exposed to the bottom of the upper cylindrical-hollow through hole of brush-retaining portion 28*a* by welding, to provide electric connection. In a similar manner, a flexible pig-tale harness 33*b* is electrically connected between the square base of second brush 30*b* and the downward terminal 31*a* exposed to the bottom of the lower cylindrical-hollow through hole of brush-retaining portion 28*a* by welding, to provide electric connection.

The lengths of pig-tale harnesses 33*a*-33*b* are set to appropriate lengths sufficient to restrict maximum sliding movements (maximum axially-extended positions) of second brushes 30*a*-30*b* relative to sleeves 29*a*-29*b* for preventing the second brushes 30*a*-30*b* from falling out of the respective sleeves 29*a*-29*b* by the spring forces of coil springs 32*a*-32*b*.

An annular seal member 34 is interleaved between the outer periphery of the root (the basal end) of brush-retaining portion 28*a* and an annular groove formed in the opening end of the cylindrical wall portion 3*c* of cover main body 3*a*. When the brush-retaining portion 28*a* has been inserted and fitted to the retaining through-hole 3*d* of the cylindrical wall portion 3*c* of cover main body 3*a*, seal member 34 is brought into elastic-contact with the annular groove of the opening end of the cylindrical wall portion 3*c* by virtue of its elastic deformation, to provide a good sealing action.

Electric current supply from the car battery to the upward terminals 31*b*, 31*b* is controlled by a control unit (not shown).

As seen in FIG. 2, each of the diametrically-opposed tab-like brackets 28*c*, 28*c* is formed into a substantially triangular shape, and formed with a bolt insertion hole (a through hole) 28*e*. Thus, brush retainer 28 is fixedly connected to the cover main body 3*a* by means of bolts, which are inserted through the respective bolt insertion holes 28*e*, 28*e* of tab-like brackets 28*c*, 28*c* and screwed into respective female screw-threads (not shown) formed in the cover main body 3*a*.

The previously-discussed motor output shaft 13 and eccentric shaft 39 are rotatably supported by means of the small-diameter ball bearing 37 and the needle bearing 38. Small-diameter ball bearing 37 is installed on the outer peripheral surface of the root of the shank 10*b* near the head 10*a* of cam bolt 10. On the other hand, needle bearing 38 is mounted on the outer peripheral surface of cylindrical portion 9*b* of driven member 9, and arranged in close proximity to the right-hand side end (viewing FIG. 1) of small-diameter ball bearing 37 such that these bearings 37-38 are juxtaposed to each other.

Needle bearing 38 is comprised of a cylindrical retainer 38*a* press-fitted into the inner peripheral surface of eccentric shaft 39 and a plurality of needle rollers 38*b* (rolling elements) rotatably retained inside of the retainer 38*a*. Each of needle rollers 38*b* is in rolling-contact with the outer peripheral surface of cylindrical portion 9*b* of driven member 9.

The inner ring of small-diameter ball bearing 37 is retained between the annular front end face of cylindrical portion 9*b* of driven member 9 and the annular washer 10*c* of cam bolt 10. On the other hand, the outer ring of small-diameter ball bearing 37 is press-fitted to the stepped portion defined between the small-inside-diameter section and the large-inside-diameter section of eccentric shaft 39, in a manner so as to be axially positioned in place by abutment with the inside annular face of the stepped portion of eccentric shaft 39.

A small-diameter oil seal (a seal member) 46 is interleaved between the outer peripheral surface of large-diameter portion 13*a* of motor output shaft 13 (eccentric shaft 39) and the inner peripheral surface of axially-leftward extending cylindrical portion 5*d* of housing 5, for preventing leakage of lubricating oil from the inside of speed reducer 8 toward the inside of electric motor 12. That is, oil seal 46 is provided to create a non-leaking, partitioning union between the electric motor 12 and the speed reducer 8.

The control unit (not shown) includes an input/output interface (I/O), memories (RAM, ROM), and a microprocessor or a central processing unit (CPU). The input/output interface (I/O) of the control unit receives input information from various engine/vehicle sensors, namely, a crank angle sensor, a cam shaft angle sensor, an airflow meter, an engine temperature sensor (an engine coolant temperature sensor), an accelerator opening sensor, and the like. Within the control unit, the CPU allows the access by the I/O interface of input informational data signals from the engine/vehicle sensors. The CPU is responsible for carrying the engine control program (i.e., the ignition-timing/throttle/fuel-injection/valve-timing control program) stored in memories, and is capable of performing necessary arithmetic and logic operations, depending on the current engine/vehicle operating condition, determined based on latest up-to-date informational data signals from the engine/vehicle sensors. Computational results (arithmetic calculation results), that is, calculated output signals are relayed through the output interface circuitry of the control unit to output stages (actuators), for electronic spark control, control of an electronically-controlled throttle valve, control of the fuel-injection system, and control of the VTC system. Concretely, the control unit is configured to detect an actual relative phase of camshaft 2 to timing sprocket 1 responsively to input informational signals from the crank angle sensor and the cam angle sensor and also configured to determine a desired relative phase of camshaft 2 to timing sprocket 1 depending on the current engine/vehicle operating condition. The control unit is further configured to perform rotational speed control of motor output shaft 13 by controlling electric-current supply to the electromagnetic coil 18 of electric motor 12. The rotational speed of motor output shaft 13 is reduced by means of the speed reducer 8. In this manner, the actual relative phase of camshaft 2 to timing sprocket 1 can be controlled and brought closer to the desired value.

As seen from the cross sections of FIGS. 1 and 3, and the perspective disassembled view of FIG. 2, speed reducer 8 is mainly comprised of the eccentric shaft 39 (constructing a part of the eccentric rotation member) that performs eccentric rotary motion, a middle-diameter ball bearing 47 (constructing the remainder of the eccentric rotation member) installed on the outer periphery of eccentric shaft 39, a plurality of rollers (serving as rolling elements) 48 rotatably installed on the outer periphery of middle-diameter ball bearing 47 and circumferentially arranged substantially at regular intervals, the cage 41 configured to partition, retain and guide these rollers 48, kept in rolling-contact with an outer ring 47*b* (described later) of middle-diameter ball bearing 47, in the circumferential direction by respective roller-holding holes 41*b* (in other words, respective axially-protruding lugs), while permitting a slight radial displacement (a slight oscillating motion) of each of rollers 48, and the driven member 9 formed integral with the cage 41, and the internal-tooth structural member 19 with the waveform internal toothed portion 19*a*.

Eccentric shaft 39 is formed into a shouldered cylindrical-hollow shape. Eccentric shaft 39 is constructed by a small-diameter portion 39*a* (at the front end) and a large-diameter portion 39*b* (at the rear end). The small-diameter portion 39*a* of eccentric shaft 39 is press-fitted into the inner peripheral surface of large-diameter portion 13*a* of motor output shaft 13. The large-diameter portion 39*b* of eccentric shaft 39 is a substantially cylindrical cam. The geometric center "Y" of the cam contour surface of the outer periphery of large-diameter portion 39*b* of eccentric shaft 39 is slightly displaced from the axis "X" (i.e., the rotation center "X" shown in FIGS. 1 and 3) of motor output shaft 13 in the radial direction.

As viewed from the longitudinal cross section of FIG. 1, that is, as viewed in the radial direction, middle-diameter ball bearing 47 is laid out to overlap with the needle bearing 38 over almost the entire inner peripheral surface.

Middle-diameter ball bearing 47 is comprised of an inner ring 47*a*, the outer ring 47*b*, and balls 47*c* rotatably disposed and confined between them. The inner ring 47*a* of ball bearing 47 is press-fitted onto the outer peripheral surface (i.e., the eccentric-cam contour surface) of large-diameter portion 39*b* of eccentric shaft 39 in a manner so as to be axially positioned in place. In contrast to the inner ring 47*a*, the outer ring 47*b* is not securely fixed in the axial direction. That is, the outer ring 47*b* is free and therefore is able to move contact-free. Concretely, the left-hand sidewall (viewing FIG. 1) of the outer ring 47*b*, facing the electric-motor side, is kept out of contact with the housing 5 of electric motor 12, while the right-hand sidewall of the outer ring 47*b*, axially opposed to the annular bottom of cage 41, is kept out of contact with the inside wall surface of the annular bottom of cage 41. More concretely, a very small axial clearance "Caxial" (a first clearance) is defined between the right-hand sidewall of the outer ring 47*b* and the inside wall surface of the annular bottom of cage 41, axially opposed to each other. Rollers 48, interleaved between the outer periphery of outer ring 47*b* of middle-diameter ball bearing 47 and the waveform internal toothed portion 19*a* of internal-tooth structural member 19, are held in rolling-contact with the outer peripheral surface of outer ring 47*b*. A crescent-shaped annular clearance "Cannular" (a second clearance) is defined between the outer peripheral surface of outer ring 47*b* and the substantially comb-tooth shaped protruding portion (the substantially cylindrical portion 41*a*) of cage 41. Owing to eccentric rotary motion of eccentric shaft 39, middle-diameter ball bearing 47 is radially moved or displaced by virtue of the crescent-shaped annular clearance "Cannular". That is, the crescent-shaped annular clearance "Cannular" permits a slight radial displacement (a slight oscillating motion) of middle-diameter ball bearing 47.

Each of rollers 48 is made from iron-based metal material, and formed as a cylindrical solid roller. Owing to the eccentric displacement (oscillating motion) of middle-diameter ball bearing 47, the radially-inward contact surface of each of rollers 48, included within a given area, is brought into abutment (rolling-contact) with the outer peripheral surface of the outer ring 47*b* of middle-diameter ball bearing 47. On the other hand, the radially-outward contact surfaces of some of rollers, associated with the given area, are fitted into some troughs of internal teeth 19*a* of internal-tooth structural member 19. That is, in the eccentric position of the eccentric rotation member (namely, the middle-diameter ball bearing 47 and eccentric shaft 39) shown in FIG. 3, roller 48, located at the 12 o'clock position, is brought into completely fitted-engagement (deeply meshed-engagement) with the inner face of the trough between the uppermost two adjacent internal teeth 19*a*, 19*a*. In contrast, roller 48, located at the 6 o'clock position, is brought out of engagement. That is, owing to the eccentric displacement (oscillating motion) of the eccentric rotation member (i.e., the middle-diameter ball bearing 47 and eccentric shaft 39), rollers 48 can radially oscillate, while being circumferentially guided by respective axially-protruding lugs (respective roller-holding holes 41*b*) of cage 41.

To ensure smooth operation of the electric-motor-driven phase-converter equipped VTC apparatus, lubricating oil is supplied into the internal space of speed reducer 8 by lubricating-oil supply means. As shown in FIG. 1, the lubricating-oil supply means is comprised of an annular oil supply passage (not numbered), which is annularly grooved in the outer periphery of the journal of camshaft 2 rotatably supported by camshaft-journal bearings 42 mounted on the cylinder head 40 and to which lubricating oil is supplied from a main oil gallery (not shown), an axial oil supply hole 51, a small-diameter axial oil hole 52, and large-diameter oil drain holes (not shown). Axial oil supply hole 51 is formed in the front end of camshaft 2 to communicate the annular oil supply passage via an oil groove, cut in the front end face of camshaft 2 and configured to communicate the downstream end of axial oil supply hole 51. Small-diameter axial oil hole 52 is formed as a through hole in the driven member 9, such that one end of small-diameter axial oil hole 52 is opened into the axial oil supply hole 51 through the oil groove cut in the camshaft end face and the other end of small-diameter axial oil hole 52 is opened into the internal space defined near both the needle bearing 38 and the middle-diameter ball bearing 47. Large-diameter oil drain holes (not shown) are formed in the driven member 9 as oil outlets.

During operation, lubricating oil is constantly fed from the discharge port of an oil pump (not shown) into the oil supply hole 51 via the main oil gallery formed in the cylinder head. Hence, by the previously-discussed lubricating-oil supply means, lubricating oil can be fed via the oil supply hole 51 to the internal space 44 and stays in the internal space 44. Thus, sufficient lubricating oil can be constantly fed from the internal space 44 to moving parts, namely, middle-diameter ball bearing 47, rollers 48, and the like. By the way, undesirable leakage of lubricating oil, staying in the internal space 44, to the inside of the electric-motor housing 5 can be prevented or adequately suppressed by means of the small-diameter oil seal 46.

The fundamental operation of the VTC apparatus of the embodiment is hereunder described in detail.

When the engine crankshaft rotates, timing sprocket 1 rotates in synchronism with rotation of the crankshaft through the timing chain (not shown). On one hand, torque flows from the timing sprocket 1 through the internal-tooth structural member 19 via the annular female screw-threaded member 6 to the housing 5 of electric motor 12, and thus permanent magnets 14-15 and stator 16, all attached to the inner periphery of housing 5, rotate together with the housing 5. On the other hand, torque flows from the timing sprocket 1 through the internal-tooth structural member 19 via the rollers 48, cage 41, and driven member 9 to the camshaft 2. Thus, camshaft 2 is rotated to operate (open/close) the intake valves against the spring forces of the valve springs by the intake-valve cams.

During a given engine operating condition after the engine start-up, an electric current is applied from the control unit through the terminal strips 31, 31, pig-tale harnesses 33*a*-33*b*, second brushes 30*a*-30*b*, and slip rings 26*a*-26*b* to the electromagnetic coil 18 of electric motor 12. Hence, motor output shaft 13 is driven. Then, the output rotation from the motor output shaft 13 is reduced by means of the speed reducer 8, and thus the reduced motor speed (in other words, the multiplied motor torque) is transmitted to the camshaft 2.

That is, when eccentric shaft 39 rotates eccentrically during rotation of motor output shaft 13, each of rollers 48 moves and relocates from one of two adjacent internal teeth 19*a*, 19*a* to the other with one-tooth displacement per one complete revolution of motor output shaft 13, while being held in rolling-contact with the outer ring 47*b* of middle-diameter ball bearing 47 and simultaneously radially guided by the associated axially-protruding lug (the associated roller-holding hole 41*b*) of cage 41. By way of the repeated relocations of each of rollers 48 every revolutions of motor output shaft 13, rollers 48 move in the circumferential direction with respect to the waveform internal toothed portion 19*a* of internal-tooth structural member 19, while being held in rolling-contact with the outer ring 47*b* of middle-diameter ball bearing 47. In this manner, torque is transmitted through the driven member 9 to the camshaft 2, while the rotational speed of motor output shaft 13 is reduced. The reduction ratio of this type of speed reducer 8 can be determined by the number of rollers 48, in other words, the number of roller-holding holes 41*b* (i.e., the number of axially-protruding lugs of cage 41). The fewer the number of rollers 48, the lower the reduction ratio. That is, the reduction ratio can be arbitrarily set depending on the number of rollers 48.

As discussed above, by execution of rotational speed control of motor output shaft 13, camshaft 2 is rotated in a normal-rotational direction or in a reverse-rotational direction with respect to the timing sprocket 1, and thus an angular phase of camshaft 2 relative to timing sprocket 1 is changed, and as a result intake valve open timing (IVO) and intake valve closure timing (IVC) can be phase-advanced or phase-retarded.

As clearly shown in FIG. 4, the clockwise rotary motion (normal-rotational motion) of camshaft 2 relative to timing sprocket 1 is restricted by abutment between the counterclockwise edge of stopper 61*b* and the clockwise edge 2*c* of stopper groove 2*b*. On the other hand, the counterclockwise rotary motion (reverse-rotational motion) of camshaft 2 relative to timing sprocket 1 is restricted by abutment between the clockwise edge of stopper 61*b* and the counterclockwise edge 2*d* of stopper groove 2*b*.

More concretely, when the driven member 9 (camshaft 2) rotates in the same rotation direction as timing sprocket 1, during eccentric rotary motion of eccentric shaft 39, the maximum normal-rotational motion of driven member 9 (camshaft 2) is restricted by abutment between the counterclockwise edge of stopper 61*b* and the clockwise edge 2*c* of stopper groove 2*b*. Thus, the angular phase of camshaft 2 relative to timing sprocket 1 is changed to the maximum phase-advance state.

Conversely, when the driven member 9 (camshaft 2) rotates in the reverse-rotational direction, opposite to the rotation direction of timing sprocket 1, during eccentric rotary motion of eccentric shaft 39, the maximum reverse-rotational motion of driven member 9 (camshaft 2) is restricted by abutment between the clockwise edge of stopper 61*b* and the counterclockwise edge 2*d* of stopper groove 2*b*. Thus, the angular phase of camshaft 2 relative to timing sprocket 1 is changed to the maximum phase-retard state.

As a result of this, intake-valve open timing (IVO) and intake-valve closure timing (IVC) can be properly phase-changed, so as to improve the engine performance, such as fuel economy and engine power output, depending on the engine/vehicle operating condition.

In the shown embodiment, plug 53 is press-fitted into the inner peripheral surface of small-diameter portion 13*b* of motor output shaft 13. Lubricating oil, supplied from the small-diameter axial oil hole 52 of the lubricating-oil supply means to the inside of eccentric shaft 39 for lubrication of each of needle bearing 38 and ball bearing 37, is sealed by the plug 53 in a fluid-tight fashion, thereby adequately suppressing undesirable oil leakage from the front end of the cylindrical-hollow motor output shaft 13 to the outside.

Even when plug 53 is undesirably displaced axially forward owing to hydraulic pressure of lubricating oil supplied into the cylindrical-hollow motor output shaft 13, the front end face 53*c* of plug 53 is brought into abutted-engagement with the top face 55*b* of protruding portion 55 of cover main body 3*a*. By virtue of abutment between the front end face 53*c* of plug 53 and the top face 55*b* of protruding portion 55, a further forward displacement of plug 53 is restricted, thus suppressing the plug 53 from slipping out of the front opening end of the cylindrical-hollow motor output shaft 13.

In particular, in the shown embodiment, the top 55*a* of protruding portion 55 is partially disposed within the internal space of the front end of small-diameter portion 13*b* of motor output shaft 13. Hence, the axial clearance "S1", defined between the inside face 3*f* of cover main body 3*a* of cover member 3 and the axially-protruding annular edged portion of small-diameter portion 13*b* of motor output shaft 13, axially opposed to each other, can be set to a comparatively large dimension. Therefore, even in the presence of an axial displacement of the cylindrical-hollow motor output shaft 13 toward the cover member 3, occurring owing to vibrations produced during rotary motion of camshaft 2, it is possible to avoid the front end of motor output shaft 13 from being brought into collision-contact with the cover member 3 by virtue of appropriate setting of axial clearance "S1" to the comparatively large dimension.

Also, in spite of setting of axial clearance "S1" to the comparatively large dimension, it is unnecessary to set the axial length "L" of plug 53 longer by the provision of the protruding portion 55, thus effectively suppressing the size of the VTC apparatus from increasing.

Furthermore, the core metal 53*a* of plug 53 is fully covered or fully coated with the elastic rubber material 53*b* around the entire surface. An elastic force, arising from the elastic deformation of the coated elastic rubber material 53*b* (in particular, the press-fitted cylindrical outer peripheral portion of the coated elastic rubber material 53*b*), contributes the enhanced sealing performance of plug 53, and also results in an increase in press-fit force of plug 53 press-fitted into the inner peripheral surface of small-diameter portion 13*b* of motor output shaft 13, thereby effectively suppressing the plug 53 from being axially displaced relatively to the cylindrical-hollow motor output shaft 13 owing to hydraulic pressure of lubricating oil supplied into the motor output shaft 13.

Additionally, as seen from the longitudinal cross section of FIG. 1, in the shown embodiment, one coil winding 18*a* of the coil windings of electromagnetic coil 18 is arranged in close proximity to the commutator 21 in the axial direction, whereas the other coil winding 18*b* is arranged to be accommodated in an annular recessed section 5*e* of the bottom 5*b* of housing 5 in a manner so as to axially overlap with the annular recessed section 5*e*. Thus, it is possible to reduce the axial length of the VTC apparatus as much as possible. This allows excellent mountability of the VTC apparatus on the internal combustion engine.

[Second Embodiment]

Figure 6:
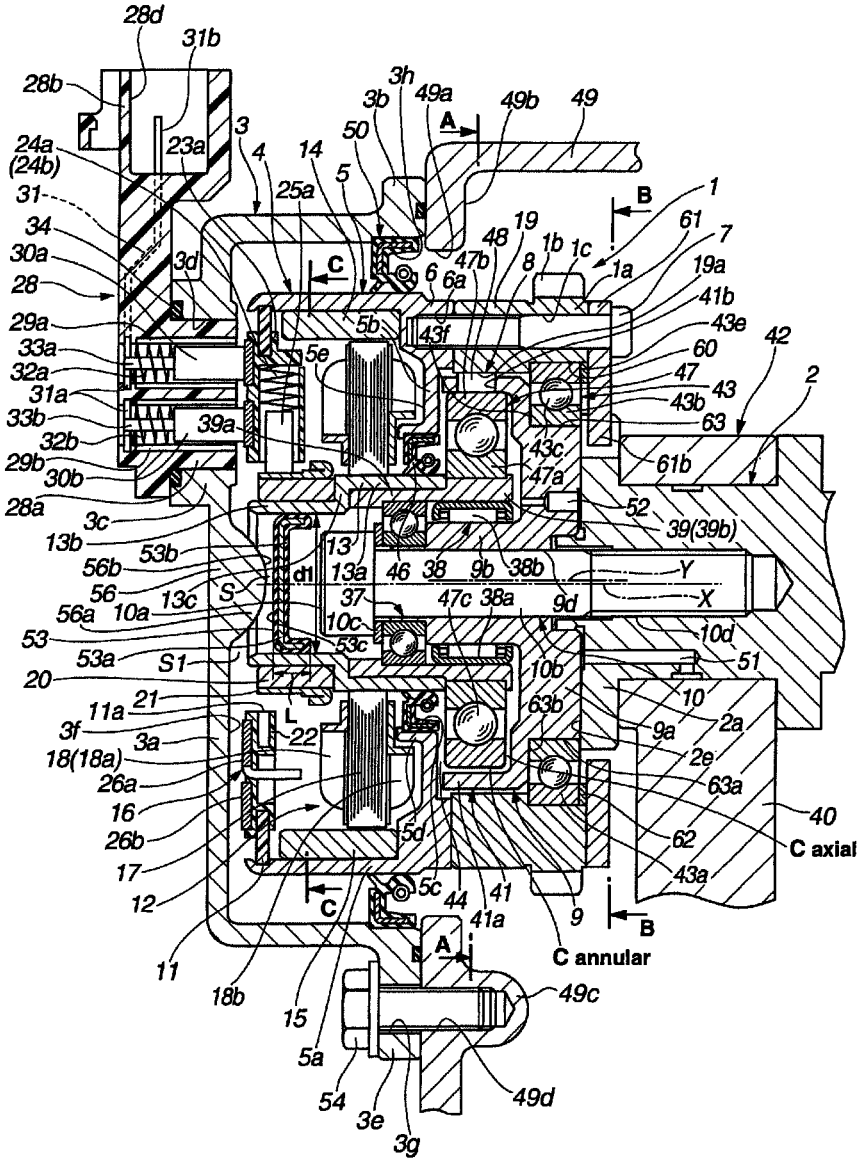
FIG. 6 is a longitudinal cross-sectional view illustrating a second embodiment of a VTC apparatus.

Referring now to FIG. 6, there is shown the VTC apparatus of the second embodiment. The VTC apparatus of the second embodiment differs from the first embodiment in that, in the second embodiment, the top 56*a* of an axially rearward protruding portion 56 is formed into a hemispherical shape. That is, in the second embodiment, the top face 56*b* of the top 56*a* of protruding portion 56 is formed as a hemispherical surface. The top 56*a* of protruding portion 56 is partially disposed within the internal space of the front end of small-diameter portion 13*b* of motor output shaft 13. The innermost end of the hemispherical surface (i.e., the center of the top face 56*b*) is laid out to be axially opposed to the front end face 53*c* of plug 53 with a slight axial clearance "S". The other construction of the second embodiment is the same as the first embodiment.

Therefore, in a similar manner to the first embodiment, in the VTC apparatus of the second embodiment, by virtue of abutment between the front end face 53*c* of plug 53 and the top face 56*b* (i.e., the hemispherical surface) of protruding portion 56, a further forward displacement of plug 53 is restricted, thus suppressing the plug 53 from slipping out of the front opening end of the cylindrical-hollow small-diameter portion 13*b* of motor output shaft 13. Also, in spite of setting of axial clearance "S1" to the comparatively large dimension, it is unnecessary to set the axial length "L" of plug 53 longer by the provision of the protruding portion 56, thus effectively suppressing the size of the VTC apparatus from increasing.

Furthermore, by virtue of the core metal 53*a* fully covered or coated with elastic rubber material 53*b* around its entire surface, a press-fit state of plug 53, which plug is press-fitted into the inner peripheral surface of the cylindrical-hollow small-diameter portion 13*b* of motor output shaft 13, can be maintained, and whereby there is a less risk of a degradation of the plug's sealing performance.

Additionally, the top 56*a* of protruding portion 56 is formed into a hemispherical shape, and hence it is possible to decrease a friction between the front end face 53*c* of plug 53 and the top face 56*b* (i.e., the hemispherical surface) of protruding portion 56 rather than the first embodiment, when the front end face 53*c* is brought into abutted-engagement with the top face 56*b*. Thus, there is a less influence on rotary motion of motor output shaft 13. As a result of this, it is possible to suppress a drop in the valve timing control accuracy.

[Third Embodiment]

Figure 7:
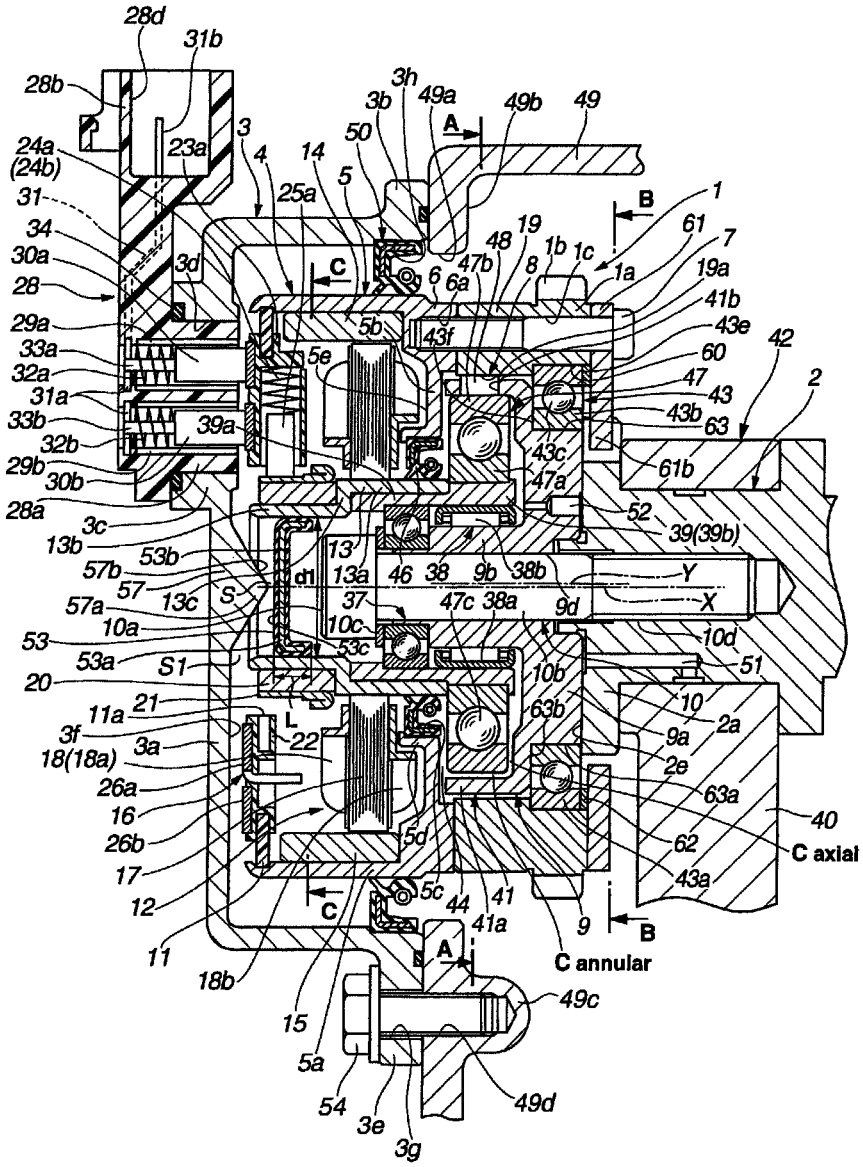
FIG. 7 is a longitudinal cross-sectional view illustrating a third embodiment of a VTC apparatus.

Referring now to FIG. 7, there is shown the VTC apparatus of the third embodiment. The VTC apparatus of the third embodiment differs from the first embodiment in that, in the third embodiment, the top 57*a* of an axially rearward protruding portion 57 is formed into a circular-cone shape. That is, in the third embodiment, the top face 57*b* of the top 57*a* of protruding portion 57 is formed as a conical surface. The top 57*a* of protruding portion 57 is partially disposed within the internal space of the front end of small-diameter portion 13*b* of motor output shaft 13. The innermost end of the conical surface (i.e., the center of the top face 57*b*) is laid out to be axially opposed to the front end face 53*c* of plug 53 with a slight axial clearance "S". The other construction of the third embodiment is the same as the first embodiment.

Therefore, the VTC apparatus of the third embodiment can provide the same operation and effects as the first and second embodiments, that is, a prevention or an avoidance or a suppression in the plug's slipping out of the front opening end of the cylindrical-hollow small-diameter portion 13*b* of motor output shaft 13 and a decrease in friction between the front end face 53*c* of plug 53 and the top face 57*b* of protruding portion 57.

[Fourth Embodiment]

Figure 8:
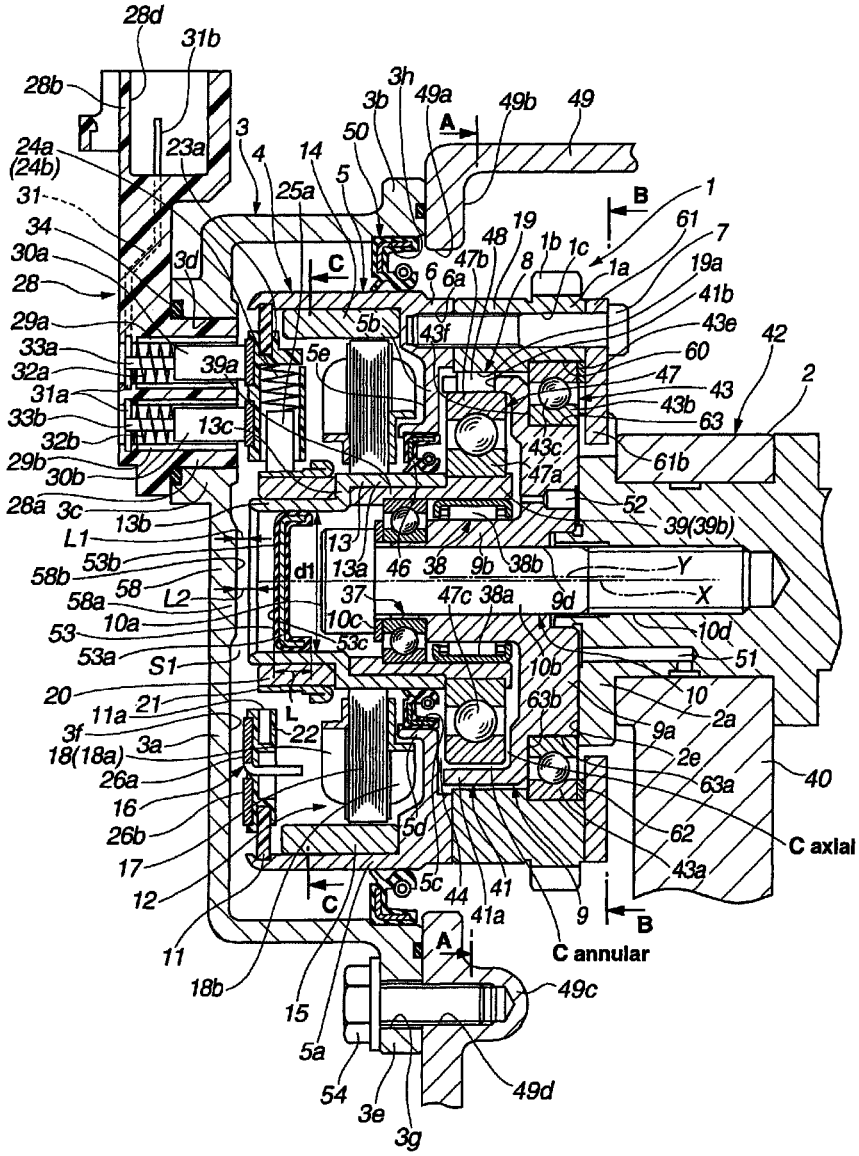
FIG. 8 is a longitudinal cross-sectional view illustrating a fourth embodiment of a VTC apparatus.

Referring now to FIG. 8, there is shown the VTC apparatus of the fourth embodiment. The VTC apparatus of the fourth embodiment differs from the first embodiment in that, in the fourth embodiment, an axially rearward protruding portion 58 is formed into a disk shape and the axial length of the disk-shaped protruding portion 58 is dimensioned shorter and hence the top 58*a* of protruding portion 58 is arranged so as not to protrude into the internal space of the front opening end of the cylindrical-hollow small-diameter portion 13*b* of motor output shaft 13. Additionally, in the fourth embodiment, the relationship between the axial length "L" of plug 53 and an axial length (an axial distance or an axial clearance) "L1" from the top face 58*b* of protruding portion 58 to the axially-protruding annular edged portion of small-diameter portion 13*b* is prescribed as discussed hereunder.

That is, due to the shortened axial length of protruding portion 58, the top face 58*b* is placed in the previously-discussed axial clearance "S1". Additionally, an axial length "L2" from the top face 58*b* to the circular inside edge of a truncated cone-shaped, tapered surface 13*d*, formed on the inner periphery of the axially-protruding annular edged portion of small-diameter portion 13*b* is set or dimensioned to be shorter than the axial length "L" of plug 53, that is, L>L2>L1.

Therefore, according to the fourth embodiment, when plug 53 is displaced axially forward relatively to the cylindrical-hollow small-diameter portion 13*b* of motor output shaft 13 with a given displacement owing to hydraulic pressure of lubricating oil in the motor output shaft 13, the front end face 53*c* of plug 53 is brought into abutted-engagement with the top face 58*b* of protruding portion 58, and as a result a further forward displacement of plug 53 is restricted. By virtue of the prescribed relationship between the axial length "L2" from the top face 58*b* to the circular inside edge of the tapered surface 13*d* (or the axial clearance "L1" defined between the top face 58*b* of protruding portion 58 and the axially-protruding annular edged portion of small-diameter portion 13*b* of motor output shaft 13) and the axial length "L" of plug 53, defined by the inequality L>L2 (or L>L1), plug 53 still remains in the front opening end of the cylindrical-hollow small-diameter portion 13*b* without slipping out of the front opening end of motor output shaft 13 by abutment with the top face 58*b* of protruding portion 58 even in the presence of a maximum axially forward displacement of plug 53 relative to the small-diameter portion 13*b*. That is, a further displacement from the maximum axial displacement of plug 53 relative to the small-diameter portion 13*b* can be effectively restricted by abutment with the top face 58*b* of protruding portion 58, thereby suppressing the plug 53 from slipping out of the front opening end of motor output shaft 13.

[Fifth Embodiment]

Figure 9:
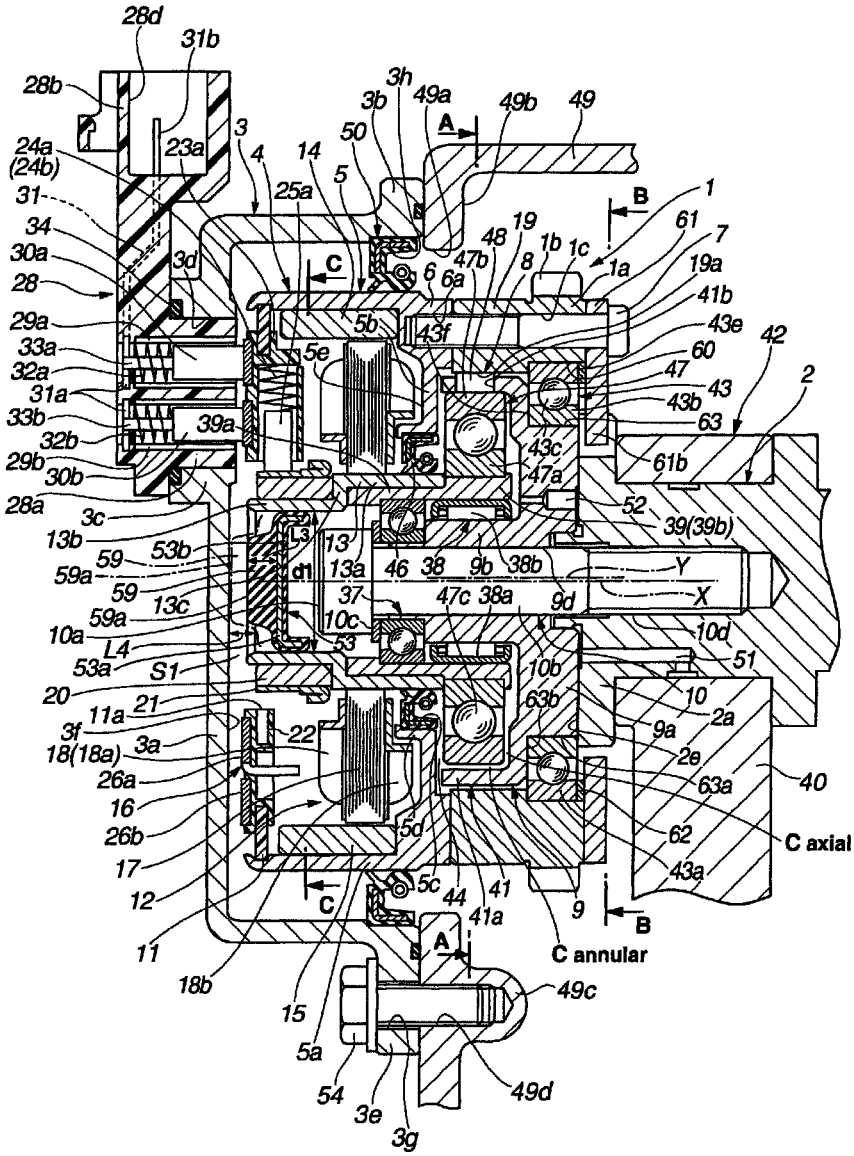
FIG. 9 is a longitudinal cross-sectional view illustrating a fifth embodiment of a VTC apparatus.

Referring now to FIG. 9, there is shown the VTC apparatus of the fifth embodiment. The VTC apparatus of the fifth embodiment somewhat differs from the first to fourth embodiments, for the reasons discussed below.

That is, in the first, second, third, and fourth embodiments, the cover main body 3*a* of cover member 3 is formed integral with the axially rearward protruding portion (i.e., the column-shaped protruding portion 55 (see FIG. 1), the hemispherical protruding portion 56 (see FIG. 6), the cone-shaped protruding portion 57 (see FIG. 7), or the disk-shaped protruding portion 58 (see FIG. 8) having a shorter axial length). In lieu thereof, in the fifth embodiment, the cross-sectional structure of plug 53 is modified such that the plug 53 itself is provided with an axially forward protruding portion (simply, a protruding portion) 59.

That is, in the fifth embodiment, the elastic rubber material 53*b* of the front end face 53*c* of plug 53 is integrally formed as the protruding portion 59 (serving as a sliding-frictional-resistance means). In more detail, when the core metal 53*a* of plug 53 is fully coated with the elastic rubber material 53*b* by vulcanized adhesion around the entire surface of core metal 53*a*, at the same time, the protruding portion 59 is integrally formed on the front end face of core metal 53*a* such that the protruding portion 59 is formed into a substantially truncated cone-shape in lateral cross section. In the fifth embodiment, an axial length "L3" from the front end face of core metal 53*a* to the front end face (the top face) 59*a* of protruding portion 59 is set or dimensioned longer than an axial length "L4" from the inside face 3*f* of cover main body 3*a* to the circular inside edge of the tapered surface 13*d* of the axially-protruding annular edged portion of small-diameter portion 13*b*, that is, L3>L4. The other construction of the fifth embodiment is the same as the first embodiment.

Therefore, according to the fifth embodiment, by virtue of the prescribed relationship between the axial length "L3" from the front end face of core metal 53*a* to the top face 59*a* of protruding portion 59 and the axial length "L4" from the inside face 3*f* of cover main body 3*a* to the circular inside edge of the tapered surface 13*d*, defined by L3>L4, the top face 59*a* of protruding portion 59 of plug 53 can be brought into abutted-engagement with the inside face 3*f* of cover main body 3*a* before the front end face of core metal 53*a* of plug 53 reaches the circular inside edge of the tapered surface 13*d* of small-diameter portion 13*b*, even in the presence of a maximum axially forward displacement of plug 53 relative to the small-diameter portion 13*b* (see the maximum axially-displaced position of plug 53, indicated by the one-dotted line in FIG. 9) owing to hydraulic pressure of lubricating oil in the motor output shaft 13. That is, a further displacement from the maximum axially-displaced position of plug 53 relative to the small-diameter portion 13*b* can be effectively restricted by abutment between the top face 59*a* of protruding portion 59 of plug 53 and the inside face 3*f* of cover main body 3*a*, thereby suppressing the plug 53 from slipping out of the front opening end of motor output shaft 13. The other operation and effects of the VTC apparatus of the fifth embodiment are the same as the first embodiment.

As discussed previously, in the first, second, third, and fourth embodiments, the cover member 3 is formed integral with the axially rearward protruding portion (i.e., the column-shaped protruding portion 55 (see FIG. 1), the hemispherical protruding portion 56 (see FIG. 6), the cone-shaped protruding portion 57 (see FIG. 7), or the disk-shaped protruding portion 58 (see FIG. 8) having a shorter axial length). As a matter of course, the shape (in particular, the cross-sectional form) of the protruding portion may be modified into an arbitrary shape.

Additionally, a friction detector (a friction detection means), in other words, a contact detector (exactly, a frictional-contact detector) may be provided for detecting a friction (a frictional-contact) between the plug 53 and the protruding portion (e.g., the column-shaped protruding portion 55, the hemispherical protruding portion 56, the cone-shaped protruding portion 57, or the disk-shaped protruding portion 58), arising from abutment between the plug 53 and the protruding portion (55; 56; 57; 58) due to an axial displacement of plug 53 relative to the small-diameter portion 13*b*. By the provision of the friction detector (the contact detector), it is possible to accurately detect an undesirable axial displacement of plug 53, in other words, a slight contact between the plug 53 and the protruding portion, which may occur owing to a degradation in the elastic rubber material 53*b* coated around the entire surface of core metal 53*a*. For example, the VTC system may be configured to inform the driver of the timing at which the plug 53 has to be replaced with a new plug, when the friction detector (the contact detector) has detected that a slight frictional-contact begins to occur. More concretely, the contact detector is configured to detect that one of two opposing faces of cover member 3 and plug 53, formed with the protruding portion (55; 56; 57; 58; 59), and the other of the two opposing faces have been brought into contact with each other in the axial direction of motor output shaft 13. Additionally, the contact between the top face (55*b*; 58*b*; 59*a*) of the protruding portion (55; 58; 59), corresponding to the one opposing face of the two opposing faces of cover member 3 and plug 53, and the other opposing face is a wall contact, and the contact detector is configured to detect that the two opposing faces have been brought into contact with each other by detecting an actuating force (actuating rotation) created by the contact between the two opposing faces and acting on the motor output shaft 13 such that the motor output shaft 13 rotates relative to the driving rotary member (timing sprocket 1) in either one of the phase-advance direction and the phase-retard direction. Also provided is the sliding-frictional-resistance means (i.e., a sliding-frictional-resistance device 53*b*) attached onto a surface of contact between the top face (55*b*; 58*b*; 59*a*) of the protruding portion (55; 58; 59), corresponding to the one opposing face of the two opposing faces of cover member 3 and plug 53, and the other opposing face, for increasing a sliding frictional resistance of the surface of contact. The sliding-frictional-resistance device is constructed by an elastic material (e.g., elastic rubber material 53*b*) with which either one of the two opposing faces is coated, thus enhancing the accuracy of detection of a slight contact between the two opposing faces of cover member 3 and plug 53. With the previously-discussed arrangement, for instance, an occurrence of the actuating force (actuating rotation) may be detected based on a valve-timing deviation from a given valve timing value, occurring in spite of a valve timing hold mode at which valve timing is held at the given valve timing value. Alternatively, an occurrence of the actuating force (actuating rotation) may be detected depending on whether a control responsiveness of one of phase-advance control and phase-retard control deviates from a normal control responsiveness when the driven rotary member 9 is rotated in either one of a phase-advance direction and a phase-retard direction relatively to the driving rotary member (timing sprocket 1) by rotation of the electric motor 12, and hence the contact detector may be configured to detect that the two opposing faces have been brought into contact with each other, when the occurrence of the actuating force (actuating rotation) has been detected based on a deviation from the normal control responsiveness.

In the shown embodiments, the large-diameter portion 39*b* of the shouldered cylindrical-hollow eccentric shaft 39 is formed as an eccentric shaft section whose geometric center "Y" is slightly displaced from the axis "X" of motor output shaft 13. In lieu thereof, the inner ring 47*a* of middle-diameter ball bearing 47 may be formed as a cylindrical-hollow eccentric shaft section whose radial thickness is gradually or continuously changed in the circumferential direction. That is, the eccentric shaft 39 may be superseded by the eccentric inner ring of middle-diameter ball bearing 47. In such a case, the large-diameter portion 39*b* has to be formed as a coaxial cylindrical-hollow section whose axis coincides with the axis "X" of motor output shaft 13. The coaxial large-diameter portion 39*b* may be formed separately from the motor output shaft 13 or may be formed as an integral coaxial cylindrical-hollow section axially extended from the rear end of motor output shaft 13.

In the shown embodiments, the VTC apparatus is exemplified in a variable valve timing control device of an internal combustion engine, in particular, a valve actuation device of the intake-valve side of the engine. In lieu thereof, the VTC apparatus of the embodiments may be applied to a valve actuation device of the exhaust-valve side of the engine.

The entire contents of Japanese Patent Application No. 2012-251790 (filed Nov. 16, 2012) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A valve timing control apparatus of an internal combustion engine, comprising:

a driving rotary member adapted to be driven by a crankshaft of the engine;

a driven rotary member adapted to be fixedly connected to a camshaft and configured to rotate relative to the driving rotary member;

an electric motor for rotating the driven rotary member relative to the driving rotary member by rotation of the electric motor;

a housing integrally connected to the driving rotary member and configured to house therein component parts of the electric motor;

a cover member adapted to be fixedly connected to an engine body and arranged to be opposed to a front end of the housing;

a slip-ring feeder device provided for electricity-feeding to the electric motor and attached to one of the front end of the housing and an inside face of the cover member opposed to each other;

a brush feeder device attached to the other of the housing and the cover member and configured to be kept in electric-contact with the slip-ring feeder device for electricity-feeding to the electric motor;

a cylindrical-hollow motor output shaft installed in the housing, and configured to rotate relative to the housing by electricity-feeding to the electric motor, and also configured such that lubricating oil is supplied into the cylindrical-hollow motor output shaft;

a bearing device disposed between an outer periphery of a cylindrical portion of the driven member and an inner periphery of the cylindrical-hollow motor output shaft;

a plug fitted to an inner peripheral surface of an axial opening end of the cylindrical-hollow motor output shaft opposed to the cover member for suppressing a leakage of lubricating oil, supplied into the motor output shaft, to an outside; and a seal member interleaved between the cover member and the housing for suppressing lubricating oil from entering a surface of electric-contact between the slip-ring feeder device and the brush feeder device, wherein a part of the inside face of the cover member, opposed to a front end face of the plug, is formed integral with a protruding portion, and a top of the protruding portion is partially disposed within the axial opening end of the cylindrical-hollow motor output shaft.

2. A valve timing control apparatus of an internal combustion engine, comprising:

a driving rotary member adapted to be driven by a crankshaft of the engine;

a driven rotary member adapted to be fixedly connected to a camshaft and configured to rotate relative to the driving rotary member;

an electric motor for rotating the driven rotary member relative to the driving rotary member by rotation of the electric motor;

a housing integrally connected to the driving rotary member and configured to house therein component parts of the electric motor;

a cover member adapted to be fixedly connected to an engine body and arranged to be opposed to a front end of the housing;

a slip-ring feeder device provided for electricity-feeding to the electric motor and attached to one of the front end of the housing and an inside face of the cover member opposed to each other;

a brush feeder device attached to the other of the housing and the cover member and configured to be kept in electric-contact with the slip-ring feeder device for electricity-feeding to the electric motor;

a cylindrical-hollow motor output shaft installed in the housing, and configured to rotate relative to the housing by electricity-feeding to the electric motor, and also configured such that lubricating oil is supplied into the cylindrical-hollow motor output shaft;

a bearing device disposed between an outer periphery of a cylindrical portion of the driven member and an inner periphery of the cylindrical-hollow motor output shaft;

a plug fitted to an inner peripheral surface of an axial opening end of the cylindrical-hollow motor output shaft opposed to the cover member for suppressing a leakage of lubricating oil, supplied into the motor output shaft, to an outside; and a seal member interleaved between the cover member and the housing for suppressing lubricating oil from entering a surface of electric-contact between the slip-ring feeder device and the brush feeder device, wherein a part of the inside face of the cover member, opposed to a front end face of the plug, is formed integral with a protruding portion, and an axial clearance defined between a top face of the protruding portion and the axial opening end of the cylindrical-hollow motor output shaft, facing the top face of the protruding portion, is dimensioned to be less than an axial length of the plug.

3. A valve timing control apparatus of an internal combustion engine, comprising:

a driving rotary member adapted to be driven by a crankshaft of the engine;

a driven rotary member adapted to be fixedly connected to a camshaft and configured to rotate relative to the driving rotary member;

an electric motor for rotating the driven rotary member relative to the driving rotary member by rotation of the electric motor;

a housing integrally connected to the driving rotary member and configured to house therein component parts of the electric motor;

a cover member adapted to be fixedly connected to an engine body and arranged to be opposed to a front end of the housing;

a slip-ring feeder device provided for electricity-feeding to the electric motor and attached to one of the front end of the housing and an inside face of the cover member opposed to each other;

a brush feeder device attached to the other of the housing and the cover member and configured to be kept in electric-contact with the slip-ring feeder device for electricity-feeding to the electric motor;

a cylindrical-hollow motor output shaft installed in the housing, and configured to rotate relative to the housing by electricity-feeding to the electric motor, and also configured such that lubricating oil is supplied into the cylindrical-hollow motor output shaft;

a bearing device disposed between an outer periphery of a cylindrical portion of the driven member and an inner periphery of the cylindrical-hollow motor output shaft;

a plug fitted to an inner peripheral surface of an axial opening end of the cylindrical-hollow motor output shaft opposed to the cover member for suppressing a leakage of lubricating oil, supplied into the motor output shaft, to an outside; and a seal member interleaved between the cover member and the housing for suppressing lubricating oil from entering a surface of electric-contact between the slip-ring feeder device and the brush feeder device, wherein one of two opposing faces of the cover member and the plug is formed with a protruding portion having a function that prevents the plug's slipping out of the axial opening end of the cylindrical-hollow motor output shaft.

4. The valve timing control apparatus as recited in claim 3, wherein:

the protruding portion is provided on the opposing face of the plug, facing the cover member.

5. The valve timing control apparatus as recited in claim 3, wherein:

each of inner and outer peripheral surfaces of the motor output shaft is formed into a circular shape in lateral cross section.

6. The valve timing control apparatus as recited in claim 5, wherein:

an outer peripheral surface of the protruding portion is formed into a circular shape in lateral cross section.

7. The valve timing control apparatus as recited in claim 3, wherein:

the plug is fully coated with an elastic material.

8. The valve timing control apparatus as recited in claim 7, wherein:

the elastic material, with which the plug is fully coated, is an elastic rubber material.

9. The valve timing control apparatus as recited in claim 3, wherein:

the protruding portion has a cross-sectional form in which a lateral cross section gradually decreases from a root to a tip.

10. The valve timing control apparatus as recited in claim 9, wherein:

a top of the protruding portion is formed into either one of a hemispherical shape and a circular-cone shape.

11. The valve timing control apparatus as recited in claim 3, further comprising:

a contact detector configured to detect that the one opposing face of the two opposing faces of the cover member and the plug, formed with the protruding portion, and the other opposing face of the two opposing faces have been brought into contact with each other in an axial direction of the motor output shaft.

12. The valve timing control apparatus as recited in claim 11, wherein:

the contact between a top face of the protruding portion, corresponding to the one opposing face of the two opposing faces of the cover member and the plug, and the other opposing face is a wall contact; and the contact detector is configured to detect that the two opposing faces have been brought into contact with each other by detecting an actuating force created by the contact between the two opposing faces and acting on the motor output shaft such that the motor output shaft rotates relative to the driving rotary member in either one of a phase-advance direction and a phase-retard direction.

13. The valve timing control apparatus as recited in claim 12, further comprising:

a sliding-frictional-resistance device provided on a surface of contact between the top face of the protruding portion, corresponding to the one opposing face of the two opposing faces of the cover member and the plug, and the other opposing face, for increasing a sliding frictional resistance of the surface of contact.

14. The valve timing control apparatus as recited in claim 13, wherein:

the sliding-frictional-resistance device is constructed by an elastic material with which either one of the two opposing faces is coated.

15. The valve timing control apparatus as recited in claim 12, wherein:

an occurrence of the actuating force is detected based on a valve-timing deviation from a given valve timing value, occurring in spite of a valve timing hold mode at which valve timing is held at the given valve timing value.

16. The valve timing control apparatus as recited in claim 12, wherein:

an occurrence of the actuating force is detected depending on whether a control responsiveness of one of phase-advance control and phase-retard control deviates from a normal control responsiveness when the driven rotary member is rotated in either one of a phase-advance direction and a phase-retard direction relatively to the driving rotary member by rotation of the electric motor; and the contact detector is configured to detect that the two opposing faces have been brought into contact with each other, when the occurrence of the actuating force has been detected based on a deviation from the normal control responsiveness.

* * * * *